United States Patent [19]

Kidd

[11] Patent Number: 4,776,481

[45] Date of Patent: Oct. 11, 1988

[54] CONTAINER CONSTRUCTION

[75] Inventor: Garry B. Kidd, Novi, Mich.

[73] Assignee: Chrysler Motors Corporation, Highland Park, Mich.

[21] Appl. No.: 54,647

[22] Filed: May 27, 1987

[51] Int. Cl.[4] ..... B65D 25/04

[52] U.S. Cl. ..... 220/22; 206/600; 229/120.33; 217/33

[58] Field of Search ..... 220/22, 22.1, 22.3; 206/600; 229/120.35; 217/30–33

[56] References Cited

U.S. PATENT DOCUMENTS

| | | | |
|---|---|---|---|
| 1,630,140 | 5/1927 | Sibbald | 220/22.1 |
| 1,906,191 | 4/1933 | Thomas | 220/22.1 |
| 2,161,624 | 6/1939 | Hoerr | 220/22.2 |
| 2,534,010 | 12/1950 | Frye | 206/600 |
| 3,146,505 | 9/1964 | Hansen | 220/23.4 |
| 3,929,248 | 12/1975 | Morrison | 220/22.1 |

*Primary Examiner*—George E. Lowrance

*Attorney, Agent, or Firm*—Edward A. Craig

[57] ABSTRACT

A container construction is provided having an erected configuration and a storage configuration. The container construction comprises a pallet, a sidewall structure, a divider and a lid. These elements may be erected into a container construction or disassembled from an erected container construction and formed into storage packs. The divider extends between oppositely disposed sidewall members. A reinforcing clip is provided at each upper juncture of the divider and sidewall structure.

3 Claims, 4 Drawing Sheets

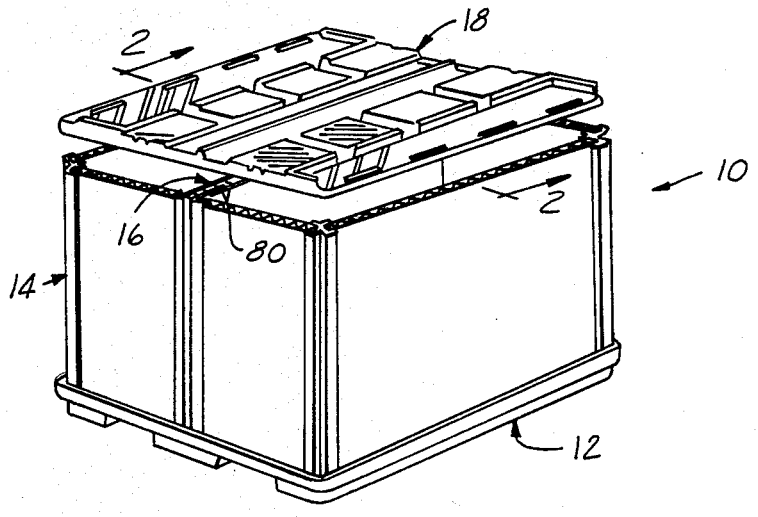
FIG. 1
FIG. 2
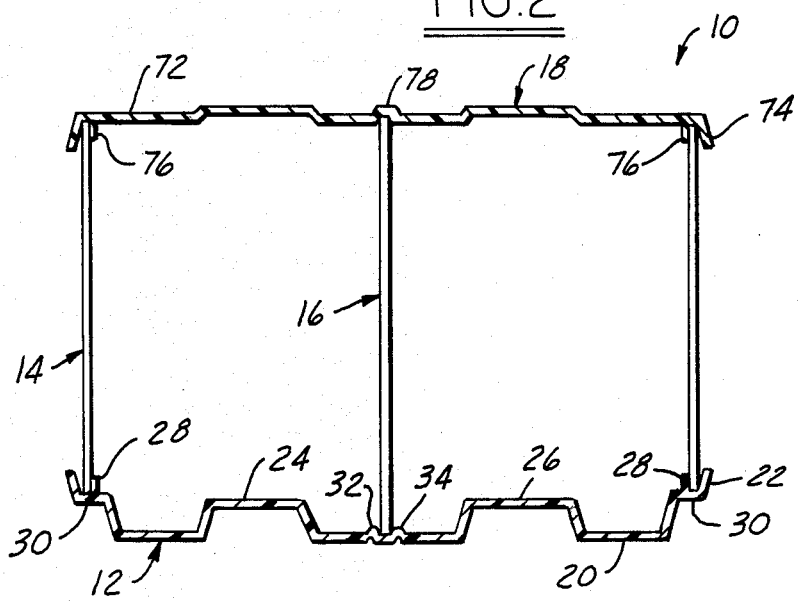

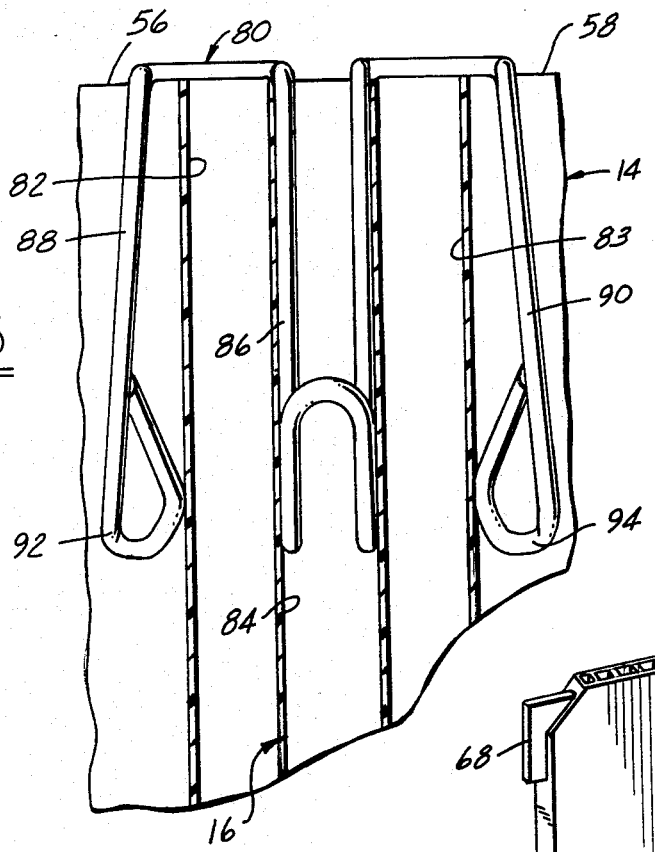
FIG.5
FIG.3
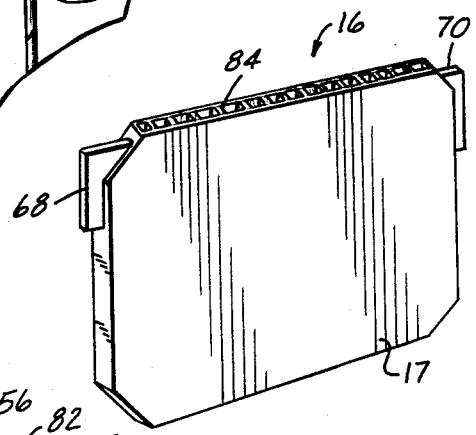
FIG.4
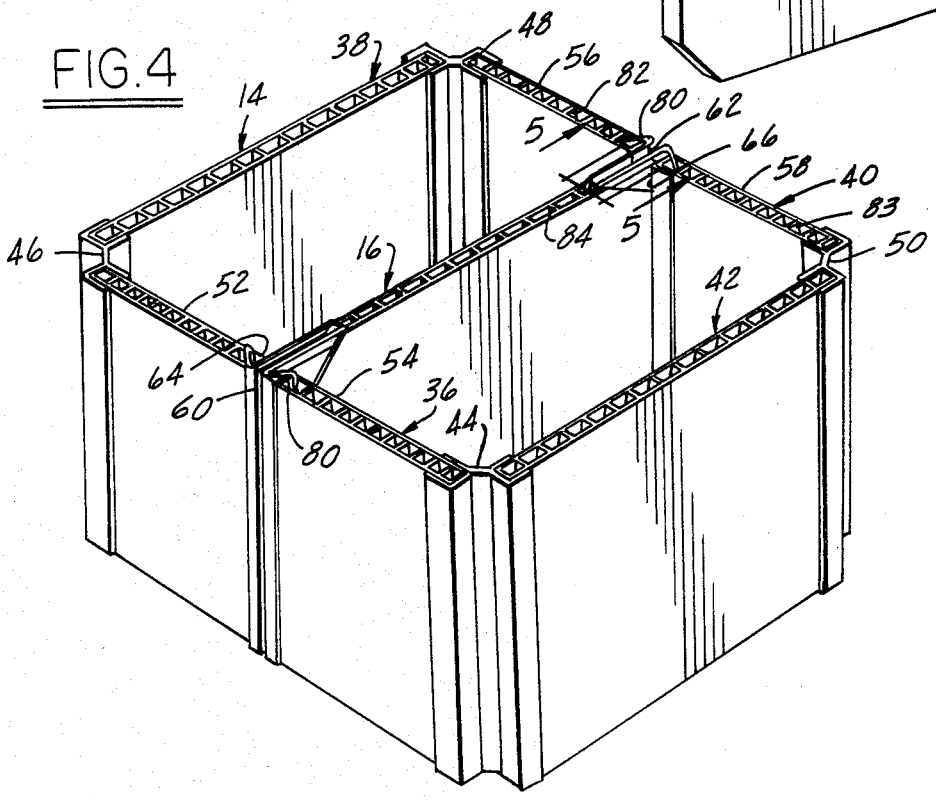

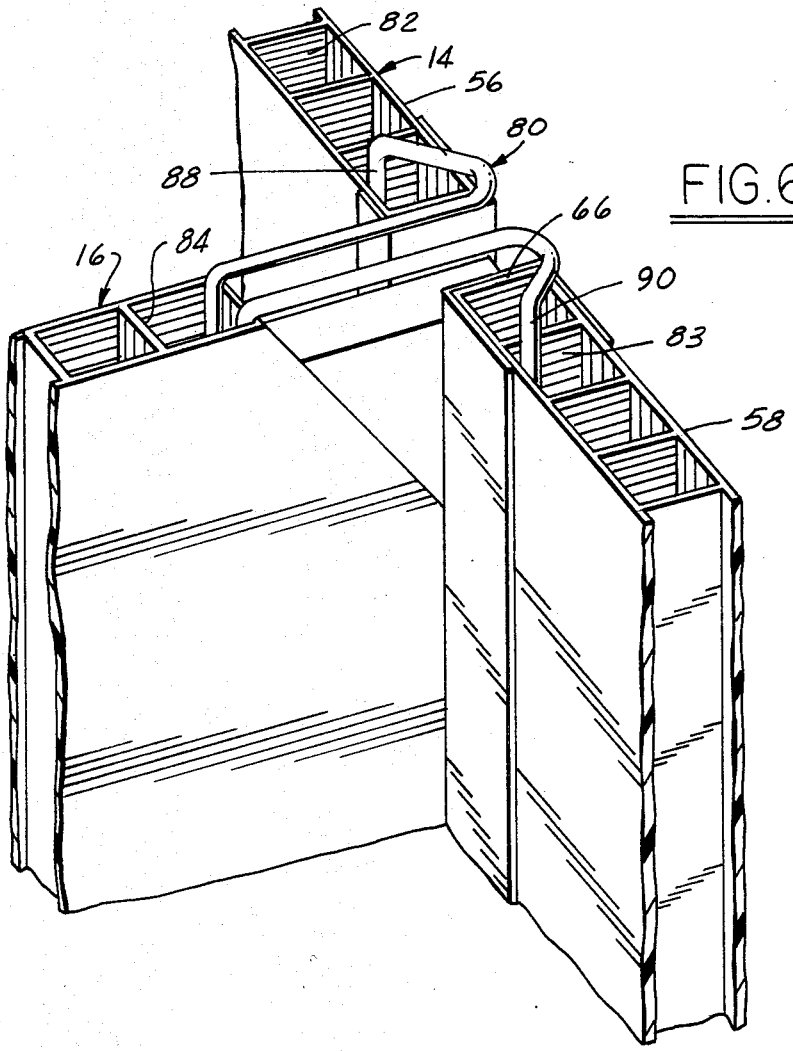
FIG.6
FIG.7
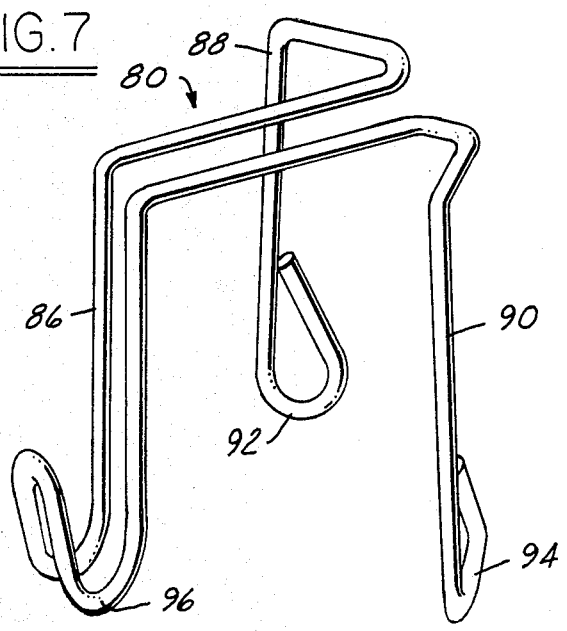

CONTAINER CONSTRUCTION

BACKGROUND OF THE INVENTION

1. Field of the Invention

This invention relates to a container construction having an erected configuration and a storage configuration. The container construction includes a pallet, a sidewall structure, a divider and a lid, each of which is a separate item. A reinforcing clip is provided to strengthen the juncture of the divider with the sidewall structure.

2. Prior Art

In modern manufacturing, it is common practice to assemble completed units at a single location from various parts and components which are shipped to the assembly location from other locations. The parts and components are normally fabricated in facilities remote from the assembly location and shipped to the assembly location in containers. Two problems have arisen in connection with use of prior art containers. One type of container which has been in common use in the past is the throw-away container. Such containers are fabricated of inexpensive materials such as cardboard and low grade wood. Throw-away containers have presented a serious disposal problem at assembly plants. It is quite costly to handle, store and transport empty throw-away containers.

However, throw-away container shave had the advantage of being low-cost items as compared with conventional reusable container that have been used in the past. Reusable containers have had the disadvantage of being initially quite expensive and being expensive to transport back from an assembly location to the location of the origin of parts and components for refilling and reshipment.

Collapsible reusable containers have been suggested. However, such collapsible containers have suffered from a low return ratio. The return ratio is the ratio between a fully erected container and a collapsed and stored container. For example, it has been common in the past for one erected container to equal three collapsed containers. This ratio is relatively low and entails an expensive shipping cost. Other disadvantages of such containers in the past is that they have been formed of relatively thick wall structural material which not only reduces the return ratio but also reduces the amount of space inside of an erected container for storage of material, thereby resulting in relatively high original shipping costs.

Collapsible sidewall structure of relatively high strength and thin configuration has recently been available for use in constructing containers. Such a collapsible sidewall structure is offered by, for example, Peninsula Plastic Co., Inc. of Auburn Hills, Mich. The material for these sidewalls is a cellular plastic material made in sheet form. The plastic material is an impact resistant polycarbonate. General Electric Co. of Stanford, Conn. markets the sheet material under the trademark LEXAN.

In my U.S. Pat. No. 4,643,314, issued Feb. 17, 1987, I have disclosed a container construction which has an erected configuration and a storage configuration wherein when erected an attempt is made to maximize the interior storage space and to configure the exterior dimensions to fit cargo trailers with efficiency, particularly cargo trailers referred to a "seatainers" which are cargo trailers shipped by ocean vessels. When dismantled and stored for return shipment, the container's construction is formable into storage packs which have a return ratio of 1:5, that is one storage pack assumes the same external volume as one-fifth of an erected container.

In accordance with the present invention, a clip structure is provided which reinforces the juncture between the divider which is used and the sidewall structure. It has been found in practice that there may be a tendency for heavily loaded containers to displace the divider/sidewall structure.

SUMMARY OF THE INVENTION

The container construction comprises a pallet, sidewall structure, a divider and a lid. The pallet includes support structure which receives the lower edges of the sidewall structure and the lower edge of the divider. The sidewall structure comprises four vertical wall members. First hinge means connect the four wall members together along vertical edges thereof to form a generally rectangular box-like structure. Each of two oppositely disposed members of the sidewall structure comprise a pair of panels. The first hinge means connects one vertical edge of each panel to a vertical edge of an adjacent sidewall member to result in the aforesaid connection. Second hinge means are provided and connect the remaining adjacent vertical edges of each pair of adjacent panels together. A vertical channel is defined by the second hinge means and adjacent edges of each pair of adjacent panels.

A divider is provided which comprises a wall member extending between the sidewall members which comprise a pair of panels. The divider includes vertical edge portions which are received in the vertical channels. The lid is received on the upper edges of the sidewall structure and includes support structure receiving the upper edge portions of the sidewall structure and the divider.

This container structure is improved by a reinforcing clip structure. The sidewall structure and the divider are further defined as being fabricated of sheet material composed of a plurality of side-by-side vertically extending cells which terminate vertically in open ends. A reinforcing clip is provided at each upper juncture of the divider and sidewall structure. Each clip is fabricated of spring wire. Each clip includes a first downwardly depending leg received in a cell of the divider adjacent to an upper juncture of the divider and sidewall structure. Each clip further includes second and third downwardly depending legs, each of which is received in a cell of one panel of the sidewall structure adjacent to said upper juncture of the divider and sidewall structure.

The spring wire separately interconnects the second and third legs with the first leg whereby the second and third legs are movable independently of each other. The first leg urges the divider towards the sidewall structure and the second and third legs urge their respective sidewall panels towards each other and toward the divider. Each of the second and third downwardly depending legs terminates in a loop oriented at an angle to press against the interior surface of a corner of a cell in which the leg is received in a direction urging their respective sidewall panels in the aforesaid direction. The first downwardly depending leg terminates in a U-shaped portion snugly received in the divider cell.

BRIEF DESCRIPTION OF THE DRAWINGS

FIG. 1 is a view in perspective of an erected container construction with the lid removed for the purpose of clarity;

FIG. 2 is a sectional view of the container construction of FIG. 1 with the lid in place and taken substantially along the line of 2—2 and looking in the direction of the arrows;

FIG. 3 is a view in perspective of the container divider;

FIG. 4 is a view in perspective of the container sidewall structure in the erected configuration with a divider in place;

FIG. 5 is a sectional view taken substantially along the line 5—5 of FIG. 4 looking in the direction of the arrows illustrating the upper portion of the divider/-sidewall structure with parts broken away for the purpose of clarity;

FIG. 6 is a view in perspective generally showing the structure of FIG. 5;

FIG. 7 is a view in perspective of the reinforcing clip;

DETAILED DESCRIPTION OF THE PREFERRED EMBODIMENT

Figure 8:
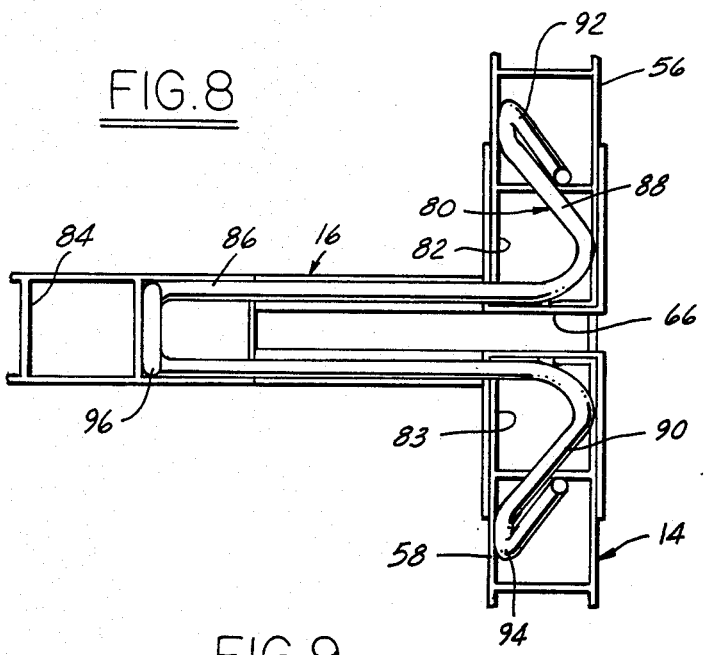
FIG. 8 is a top plan view generally showing the structure of FIG. 5.

Referring to FIGS. 1 and 2, it will be noted that the container construction 10, illustrated in the erected configuration, comprises a pallet 12, a sidewall structure 14 a divider 16 and a lid 18.

The pallet 12 is generally rectangular and includes a bottom wall 20. Sidewall means 22 extend around the periphery of the bottom wall 20 on the upper face thereof. The bottom wall 20 has a pair of substantially parallel spaced apart hollow raised portions 24, 26 on the upper face extending between two opposed edges of the pallet 12. The raised portions 24, 26 are open ended and define a pair of channels to receive the skids of a forklift truck.

Lug structure is provided on the upper face of the bottom wall 20 extending around the inner periphery of the pallet sidewall means 22 and spaced therefrom to form, with the pallet sidewall means 22, a support structure receiving the lower edges of the sidewall structure 14. The lug structure comprises a plurality of spaced-apart lug elements 28. A shelf structure 30 extends from the lug elements to the pallet sidewall means 22 for support of the lower edges of the sidewall structure 14.

Channel structure is provided on the upper face of the bottom wall 20 extending between and substantially parallel to the hollow raised portions 24, 26 for receiving the lower edge of the divider 16. The channel structure comprises a pair of elongated generally parallel spaced-apart rib elements 32, 34.

Referring now to FIG. 4, it will be noted that the sidewall structure 14 comprises four vertical wall members 36, 38, 40, 42. First hinge means 44, 46, 48, 50 connect the four wall members together along vertical edges to form a generally box-like structure when erected as shown in FIG. 4. The hinge means are fabricated of a flexible plastic material and are secured to the edges of the wall members as by adhesion. Each of two oppositely disposed wall members 36, 40 of the sidewall structure 14 comprises a pair of panels 52, 54, 56, 58 of substantially equal size. The first hinge means 44, 46, 48, 50 connect one vertical edge of each panel to a vertical edge of each adjacent sidewall member 38, 42 to result in the aforesaid connection. Second hinge means 60, 62 of the type previously described connect the remaining adjacent vertical edge of each pair of adjacent panels 52, 54 and 56, 58 together. A vertical channel 64, 66 is defined by the hinge means 60, 62 and adjacent edges of each pair of adjacent panels 52, 54 and 56, 58. Each of the vertical channels 64, 66 is in alignment with the channel structure defined by the ribs 32, 34 on the upper surface of the pallet bottom wall 20 when the sidewall structure 14 is mounted on the pallet 12.

The sidewall structure 14 is capable of being collapsed from the erected condition shown in FIG. 4 to a folded condition to assume a relatively flat storage condition in which the panels 52, 54 and 56, 58 are folded between the adjacent wall members 38, 42. pg,9

Referring to FIG. 3, it will be noted that the divider 16 comprises a wall member 17 which is fabricated of the same sheet material as the sidewall structure 14. The divider is used in an erected container to extend between the wall members 36, 40. This provides structural integrity for the container. The divider 16 has vertical edge portions which at their upper ends carry projections 68, 70 which are received in the vertical channels 64, 66. The pair of spaced apart projections 68, 70 which are inserted into the structure of the divider and held in place as by adhesion. The projections 68, 70 are elongated and extend outwardly from the upper portion of the divider. The projections terminate intermediate the upper and lower edges of the divider. As will be noted, the upper and lower corners of the divider are angled to conform to the outward flare of the sidewall means of the pallet 12 and lid 18. The lower edge portion of the divider 16 is received in the channel structure in the bottom wall 20 defined by the ribs 32, 34.

Referring to FIGS. 1 and 2, it will be noted that the lid 18 is generally rectangular and has a top wall 72. Outwardly flared sidewall means 74 extends around the periphery of the top wall 72 on the lower face thereof. Lug structure is provided on the lower face of the top wall 72 extending around the inner periphery of the lid sidewall means 74. The lug structure comprises a plurality of spaced apart lug elements 76. The lug structure is spaced from the sidewall means 74 to form, with the lid sidewall means 74, a support structure received on the upper edges of the sidewall structure 14 as will be noted in FIG. 2. Channel structure is provided on the lower surface of the top wall 72 and extends between the sidewall structure vertical ohannels 64, 66 when the container is erected. The channel structure comprises a channel 78 formed integrally with the top wall 72. The channel 78 receives the upper edge of the divider 16 as will be noted in FIG. 2 to support the upper edge of the divider.

A more detailed description of the container construction may be had by reference to the aforesaid U.S. Pat. No. 4,643,314.

A reinforcing clip 80 is provided at each upper juncture of the divider 16 and sidewall structure 14. As previously mentioned, the sidewall structure 14 and divider 16 are fabricated of sheet material. The sheet material is composed of a plurality of side-by-side vertically extending cells 82,83, 84 which, at their vertical termination, are open ended. These cells receive downwardly depending legs of the clip 80.

Figure 9:
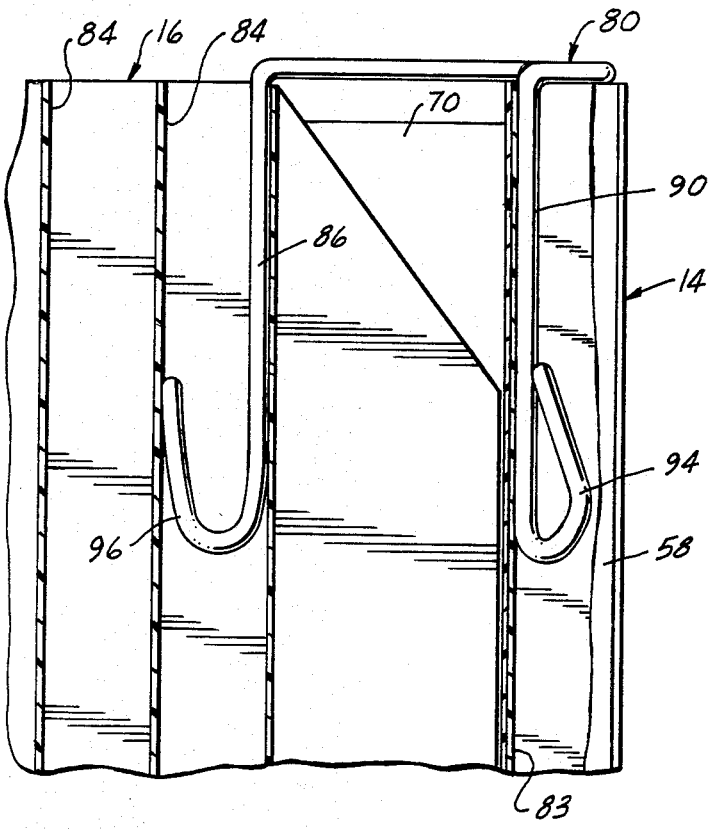
FIG. 9 is an elevational view generally showing the structure of FIG. 5.

The clip and cell relationship is shown in FIGS. 5-9. The clips are fabricated of spring wire. Each clip includes a first downwardly depending leg 86 which is received in a cell 84 of the divider 16 adjacent to an upper juncture of the divider 16 and sidewall structure 14. The clip 80 has second and third downwardly depending legs 88, 90 each of which is received in a cell 82, 83 of one panel 56, 58 as the case may be. The cells receiving these legs are also adjacent to the upper juncture of the divider and the sidewall structure. The spring wire separately interconnects the second and third legs 88, 90 with the first leg 86 whereby the second and third legs are movable independently of each other. of the divider 16 in which it is received thereby urging the divider 16 toward the sidewall structure.

The second and third legs 88, 90 urge their respective sidewall panels 52, 54 or 56, 58 toward each other and towards the divider 16. The structure which accomplishes this is a loop 92, 94 formed on the lower terminus of the legs. The loops 92, 94 are oriented at an angle to press against the interior corner surface of the cell in which the leg is received in a direction urging the respective sidewall panels in the aforesaid direction. The first downwardly depending leg 86 terminates in a U-shaped portion 96 which is snugly received within the cell receiving the leg 86 as may be noted in FIGS. 8 and 9.

I claim:

1. In a container construction comprising a pallet, a sidewall structure, a divider and a lid, the pallet including support structure receiving the lower edges of the sidewall structure and the lower edge of the divider, the sidewall structure comprising four vertical wall members, first hinge means connecting the four wall members together along vertical edges thereof to form a generally rectangular box-like structure, each of two oppositely disposed members of the sidewall structure comprising a pair of panels, the first hinge means connecting one vertical edge of each panel to a vertical edge of an adjacent sidewall member to result in the aforesaid connection, second hinge means connecting the remaining adjacent vertical edges of each pair of adjacent panels together, a vertical channel defined by the sccond hinge means and adjacent edges of each pair of adjacent panels, a divider comprising a wall member extending between the sidewall members which comprise a pair of panels, the divider including vertical edge portions received in said vertical channels, the lid being received on the upper edges of the sidewall structure and including support structure receiving the upper edge portions of the the sidewall structure and the divider, the improvement comprising: the sidewall structure and the divider each being fabricated of sheet material composed of a plurality of side-by-side vertically extending cells which at their vertical termination are open ended, a reinforcing clip provided at each upper juncture of the divider and sidewall structure, each clip being fabricated of spring wire, each clip including a first downwardly depending leg received in a cell of the divider adjacent to an upper juncture of the divider and sidewall structure, each clip further including second and third downwardly depending legs each of which is received in a cell of one panel of the sidewall structure adjacent to said upper juncture of the divider and sidewall structure, said spring wire separately interconnecting the second and third legs with the first leg whereby the second and third legs are movable independently of each other, the first leg urging the divider towards the sidewall structure and the second and third legs urging their respective sidewall panels towards each other and towards the divider.

2. A container construction as defined in claim 1, further characterized in that each of said second and third downwardly depending legs terminates in a loop oriented at an angle to press against an interior corner surface of the cell in which the leg is received to urge the respective sidewall panels in the aforesaid direction.

3. A container construction as defined in claim 1, further characterized in that the first downwardly depending leg terminates in a U-shaped portion snugly received in said cell.

* * * * *